US009295994B2

(12) United States Patent
Taylor

(10) Patent No.: US 9,295,994 B2
(45) Date of Patent: Mar. 29, 2016

(54) ALUMINUM CAN SYSTEM

(71) Applicant: William S. Taylor, Lancaster, KY (US)

(72) Inventor: William S. Taylor, Lancaster, KY (US)

( * ) Notice: Subject to any disclaimer, the term of this patent is extended or adjusted under 35 U.S.C. 154(b) by 227 days.

(21) Appl. No.: 13/786,859

(22) Filed: Mar. 6, 2013

(65) Prior Publication Data

US 2014/0251877 A1 Sep. 11, 2014

(51) Int. Cl.

| | |
|---|---|
| ***B03B 7/00*** | (2006.01) |
| ***B03C 1/30*** | (2006.01) |
| ***B03C 1/14*** | (2006.01) |
| ***B07B 7/06*** | (2006.01) |

(52) U.S. Cl.

CPC ... *B03C 1/30* (2013.01); *B03C 1/14* (2013.01); *B07B 7/06* (2013.01); *B03C 2201/20* (2013.01)

(58) Field of Classification Search

CPC ..... B03C 1/30; B65G 53/60; B07B 7/02; B07B 7/06; B07B 4/02

USPC ..... 209/23–29, 38, 135–139.1, 149, 153, 209/224

See application file for complete search history.

(56) References Cited

U.S. PATENT DOCUMENTS

| | | | | |
|---|---|---|---|---|
| 3,749,240 | A | 7/1973 | Spears et al. | |
| 3,929,628 | A | 12/1975 | Denevi et al. | |
| 4,084,496 | A | 4/1978 | Ehernberger et al. | |
| 4,257,511 | A | 3/1981 | Miller | |
| 4,387,019 | A | 6/1983 | Dale et al. | |
| 4,463,844 | A | 8/1984 | Huffman et al. | |
| 4,553,977 | A | 11/1985 | Fry | |
| 4,576,289 | A | 3/1986 | Jarrett et al. | |
| 4,787,495 | A * | 11/1988 | Tuten et al. | 194/209 |
| 4,929,342 | A | 5/1990 | Johnston | |
| 4,989,507 | A | 2/1991 | Rhoades et al. | |
| 5,163,627 | A | 11/1992 | Bouche | |
| 5,167,184 | A | 12/1992 | Rebecchi | |
| 5,234,109 | A | 8/1993 | Pederson | |
| 5,239,920 | A | 8/1993 | Schuff et al. | |
| 5,469,783 | A | 11/1995 | Fry | |
| 5,671,666 | A | 9/1997 | Wenglar | |
| 5,704,558 | A * | 1/1998 | Arrott | 241/47 |
| 5,924,834 | A | 7/1999 | Davis | |
| 6,227,847 | B1 | 5/2001 | Gillespie | |
| 6,749,138 | B2 | 6/2004 | Hart et al. | |
| 6,905,528 | B2 * | 6/2005 | Rubenach | 55/337 |
| 7,017,752 | B2 | 3/2006 | Tse | |
| 8,322,639 | B2 * | 12/2012 | Gitschel | 241/19 |
| 8,627,960 | B2 * | 1/2014 | Valerio et al. | 209/139.1 |

* cited by examiner

*Primary Examiner* — Joseph C Rodriguez
*Assistant Examiner* — Kalyanavenkateshware Kumar
(74) *Attorney, Agent, or Firm* — Pitts & Lake, P.C.

(57) ABSTRACT

An aluminum can cleaning system for separating magnetic materials and other debris from aggregate comprising aluminum cans comprises a conveyor having a magnet to cause the conveyor to retain a magnetic portion of the aggregate along a portion of the conveyor to separate the magnetic portion from a non-magnetic portion of the aggregate. The conveyor discharges the non-magnetic portion into an intake chute. An air duct has a first end in fluid communication with a lower end of the intake chute. A blower is configured to provide air flow from the intake chute into the air duct to carry the non-magnetic portion along the air duct. A channel is in fluid communication with a second end of the air duct. A screen is positioned along the channel to separate debris from aluminum cans and to direct the aluminum cans into a bin disposed proximate an opening in the channel.

20 Claims, 5 Drawing Sheets

ALUMINUM CAN SYSTEM

CROSS-REFERENCE TO RELATED APPLICATIONS

Not Applicable

STATEMENT REGARDING FEDERALLY-SPONSORED RESEARCH OR DEVELOPMENT

Not Applicable

BACKGROUND OF THE INVENTION

1. Field of Invention

The invention relates to machines for collecting recyclable materials from refuse, and more particularly, to a machine for separating a desired recyclable material, such as an aluminum container, from other refuse materials.

2. Description of the Related Art

The practice of collecting recyclable refuse materials, such as for example aluminum or other metal, cardboard, glass, etc., and submitting such materials for recycling is generally known. In the field of collecting and recycling scrap aluminum, and in particular scrap aluminum containers such as aluminum cans, bottles, and the like, (hereinafter "aluminum cans"), scrap aluminum cans are often collected together and sold in bulk to an aluminum recycling facility at a price based upon the total weight of the collected aluminum cans.

It is commonplace that such aluminum cans, when initially collected, may be soiled and/or intermixed with other refuse, such as for example dirt, paper, glass, plastic, liquids, non-aluminum metals, etc. (hereinafter "debris"). If not separated from the aluminum cans prior to submission of the aluminum cans for recycling, such debris may result in an inaccurate measurement of the weight of the collected aluminum cans, thereby making calculation of the value of the aluminum cans difficult. Furthermore, certain types of debris intermixed with aluminum cans during recycling may contaminate or damage machinery used during the recycling process and may also contaminate the resultant recycled aluminum.

Several prior art devices exist for separating one or more types of recyclable refuse materials from debris and other refuse materials. However, such devices are often cumbersome, difficult to construct, and often do not assist in measuring a weight of cleaned and collected aluminum cans prior to submission of the cans for recycling. Accordingly, there is a need in the art for an improved device for cleaning and separating aluminum cans from debris and other refuse materials.

BRIEF SUMMARY OF THE INVENTION

According to several features of the present general inventive concept, an aluminum can cleaning system for separating magnetic materials and other debris from aggregate comprising aluminum cans is disclosed herein and in the accompanying figures. In certain embodiments, the aluminum can cleaning system may include a conveyor for conveying an aggregate from a conveyor receiving end and discharging the aggregate at a conveyor discharge end. The conveyor may include a magnet configured to cause the conveyor to retain a magnetic portion of the aggregate along a portion of the conveyor to separate the magnetic portion from a non-magnetic portion of the aggregate. In certain embodiments, the magnet may be defined by a magnetic roller positioned at the conveyor discharge end, whereby the magnetic portion of the aggregate is held to the conveyor by the magnetic roller and directed along an underside of the conveyor. The present general inventive concept may, in certain embodiments, further include a magnetic waste chute positioned beneath the magnetic roller, whereby as the magnetic portion of the aggregate is directed along an underside of the conveyor and away from the magnetic roller, the magnetic portion of the aggregate is allowed to fall from the conveyor into the magnetic waste chute. In certain embodiments, the conveyor may include a first side wall disposed along a first side of the conveyor and a second side wall disposed along a second side of the conveyor, the conveyor first and second side walls being configured to limit spillage of aggregate from the conveyor.

In certain embodiments, a hopper may be positioned at the conveyor receiving end, the hopper being configured to receive aggregate therein and direct received aggregate onto the conveyor. In some embodiments, the hopper may define a generally outwardly-flared upwardly-facing open first end and may taper downwardly and inwardly to an open second end.

In certain embodiments of the present general inventive concept, the aluminum can cleaning system may include an intake chute positioned proximate the conveyor discharge end to receive the non-magnetic portion of the aggregate discharged from the conveyor. In certain embodiments, the intake chute may have an upper end defining a plurality of outwardly flared walls, the intake chute walls cooperating to limit spillage of non-magnetic aggregate from the intake chute. The aluminum can cleaning system may, in certain embodiments, have an air duct with a first end in fluid communication with a lower end of the intake chute, and a blower configured to provide an air flow from the lower end of the intake chute into the air duct, the air flow being of sufficient magnitude to carry the non-magnetic portion of the aggregate along the air duct.

The present general inventive concept may, in certain embodiments, include a channel in fluid communication with a second end of the air duct, the channel having a screen positioned therein. The screen may define openings sized to allow a debris portion of the non-magnetic portion of the aggregate to pass through the screen and to disallow aluminum cans from passing through the screen. The channel may also define an opening proximate the screen to allow aluminum cans to exit the channel. The channel may, in some embodiments, define a top wall and a bottom wall, the screen extending between the channel top and bottom walls at an angle such that aluminum cans impacting the screen are directed toward the channel bottom wall, the channel opening being defined adjacent the screen on the channel bottom wall. In certain embodiments, a bin is disposed proximate the opening to receive the aluminum cans exiting the channel. In certain embodiments, the bin may define a inclined bottom surface having a lower end intersecting a front wall of the bin and a door disposed on the front wall along an intersection of the front wall and the bottom surface, whereby when the door is opened, aluminum cans within the bin are allowed to fall from within the bin. In some embodiments, a discharge chute may be provided in fluid communication with the channel, the discharge chute being configured to receive debris passing through the screen and to direct the debris to an exterior of the bin.

The present general inventive concept may, in certain embodiments, further include a scale configured to monitor a weight of aluminum cans received in the bin. The channel, screen, and bin may be carried by the scale. In certain embodiments, the air duct may be of a cross-sectional dimension smaller than the channel, such that a space is defined along an interface of the channel and the air duct.

In certain embodiments, the air duct second end may be selectively repositionable proximate the channel, such as for example by being telescopically extendable. For example, in certain embodiments, the air duct may include a first segment and a second segment, the second segment slidably received within the first segment, the air duct further including a clamp to selectively limit sliding of the first segment proximate the second segment. In certain embodiments, the air duct first end may be selectively repositionable proximate the lower end of the intake chute. For example, the air duct may, in some embodiments, be supported by a frame, the frame being selectively adjustable to raise and lower the air duct in relation to the intake chute. In some embodiments, the frame may include a collar joined to the first segment and substantially surrounding an interface of the first segment with the second segment, the clamp being carried by the collar. In certain embodiments, the channel may be selectively repositionable proximate the air duct.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 1:
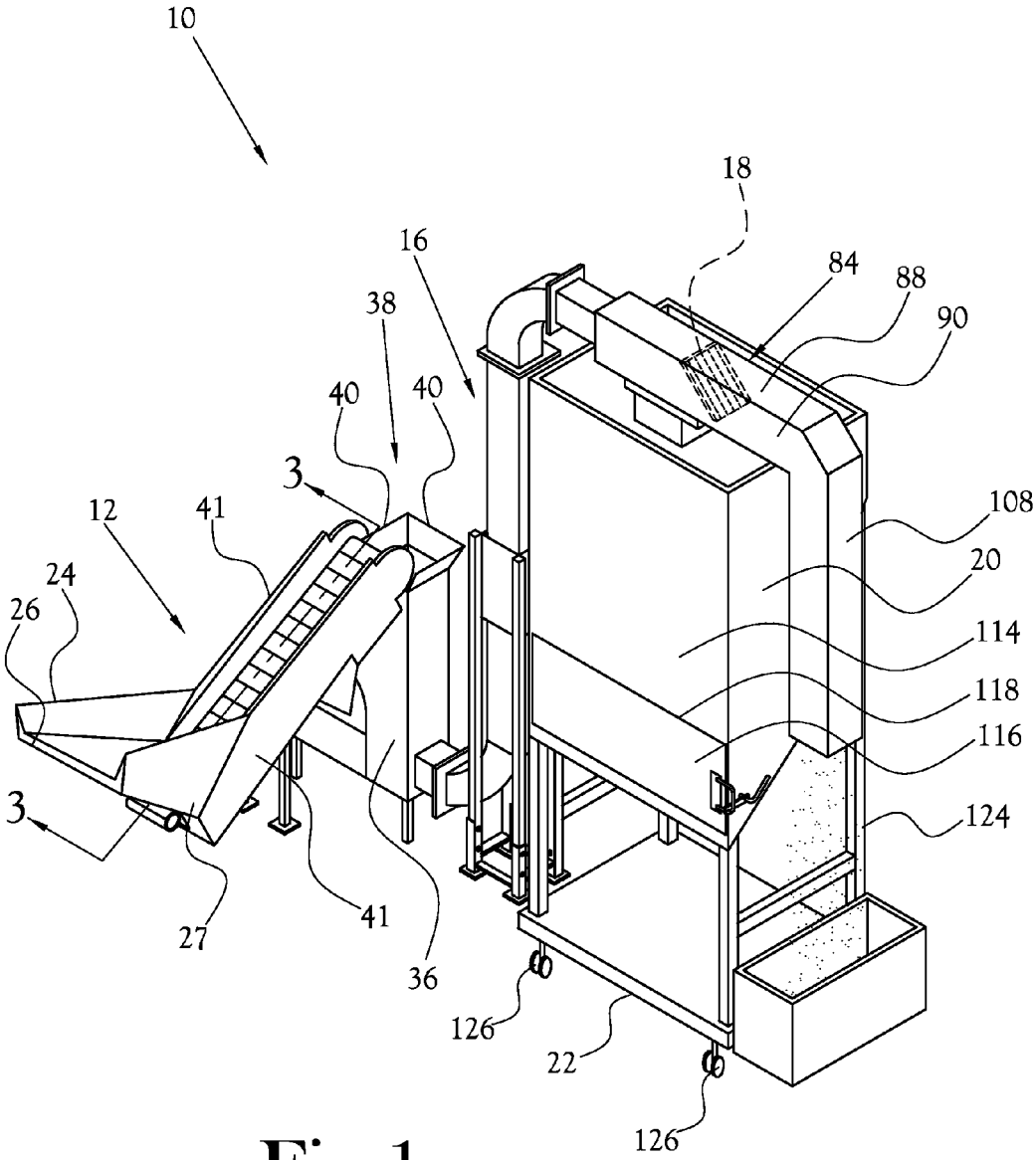
FIG. 1 is a front perspective view of one embodiment of an aluminum can cleaning system constructed in accordance with several features of the present general inventive concept.
Figure 2:
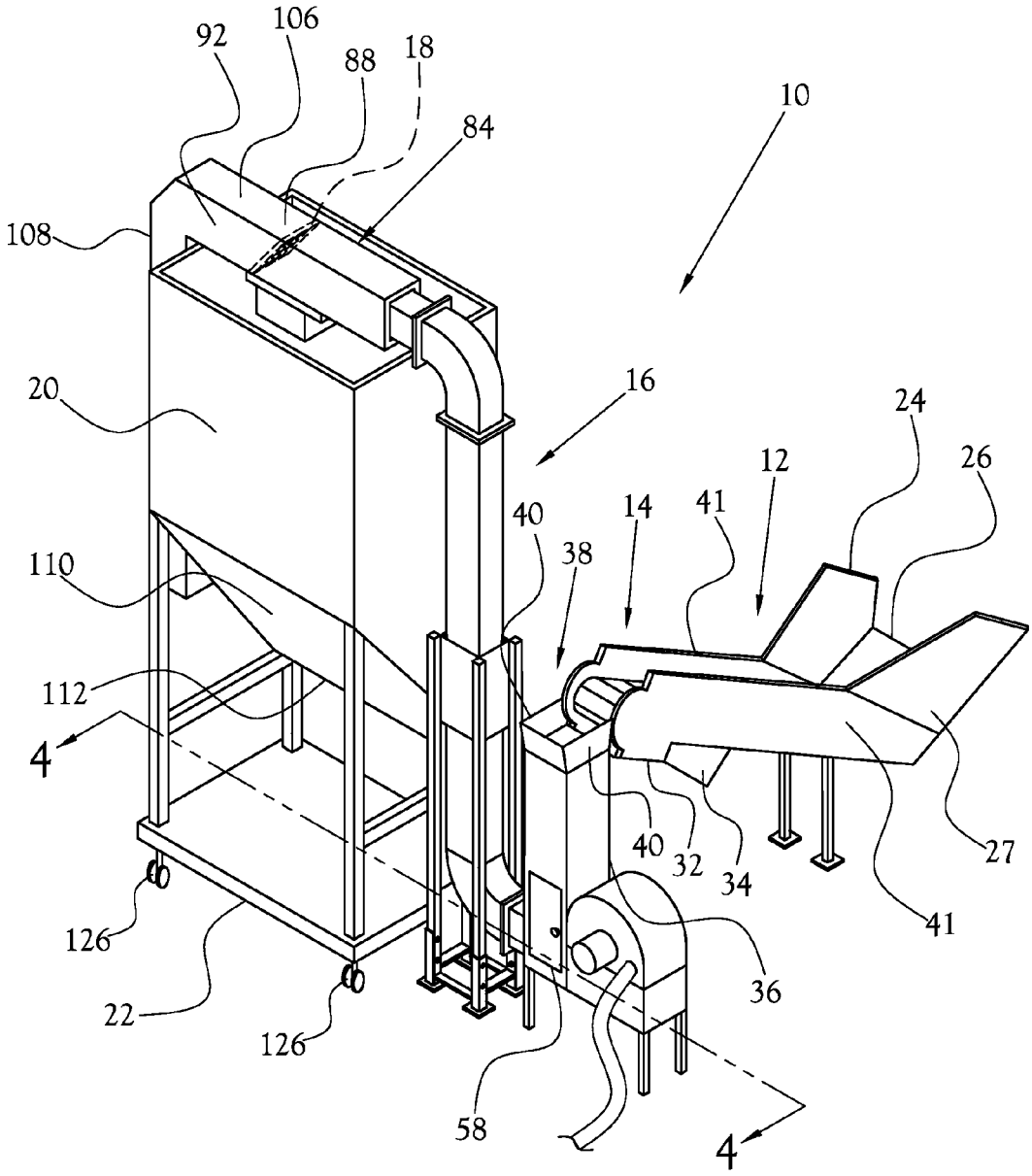
FIG. 2 is a rear perspective view of the aluminum can cleaning system of FIG. 1.

In accordance with several features of the present general inventive concept, an aluminum can cleaning system for separating magnetic metals and for cleaning debris from scrap aluminum cans is disclosed herein and in the accompanying figures. Referring to FIGS. 1 and 2, the aluminum can cleaning system, or cleaner 10, includes generally a conveyor 12 for conveying scrap aluminum cans which may contain magnetic metal and/or debris to a magnetic separator 14 that separates magnetic objects from the aluminum cans and other debris. The aluminum cans and remaining debris are then deposited into an air duct 16, wherein the aluminum cans and debris are subjected to an air flow of sufficient magnitude to carry them to a screen 18 positioned above a bin 20. The screen 18 is configured to allow debris to pass through the screen 18 and into a discharge chute 108, while directing cleaned aluminum cans into the bin 20. As will further be discussed below, the bin 20 includes a scale 22 which is configured to allow monitoring of the weight of cleaned aluminum cans received in the bin 20.

Figure 3:
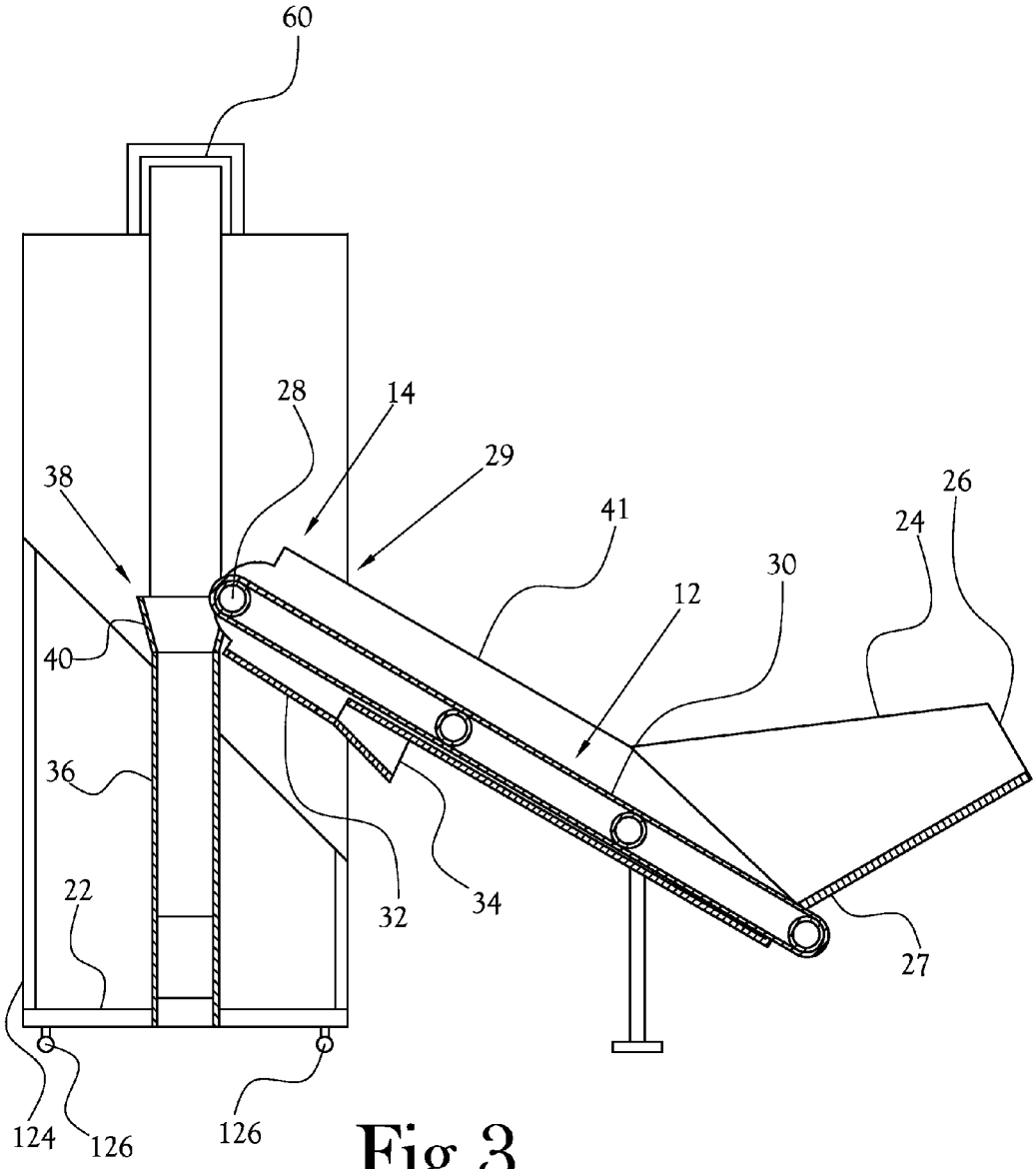
FIG. 3 is a cross-sectional view of the aluminum can cleaning system of FIG. 1 taken along line 3-3.

FIGS. 1 and 2 illustrate one embodiment of a cleaner 10 according to several features of the present general inventive concept. In the embodiment of FIGS. 1 and 2, the cleaner 10 includes a hopper 24 having a generally outwardly-flared upwardly-facing open first end 26 for receiving an aggregate that at least partially comprises aluminum cans. The hopper 24 tapers generally downwardly and inwardly to an open second end 27 which is configured to allow the aggregate received within the hopper 24 to flow outwardly therefrom and onto a conveyor 12. The conveyor 12 extends generally upwardly from the hopper second end 27 and has at its upper end 26 a magnetic separator 14 for separating magnetic objects from the aggregate. As shown in FIG. 3, in one embodiment, the magnetic separator 14 includes a magnetic roller 28 positioned at an upper end 29 of the conveyor 12 around which a conveyor belt 30 of the conveyor 12 is trained. In this configuration, as aggregate travels on the conveyor belt 30 from the hopper second end 27 to the conveyor upper end 29, non-magnetic portions of the aggregate are allowed to fall freely from the conveyor belt 30 at the conveyor upper end 29. However, magnetic objects travelling on the conveyor belt 30, upon reaching the conveyor upper end 29, are magnetically held to the conveyor belt 30 and carried completely around the upper end 29 of the conveyor 12 and begin to move backward below the conveyor 12 toward the hopper 24. As these held magnetic objects continue to move along the conveyor belt 30 below the conveyor 12 and away from the magnetic roller 28, the magnetic hold of the magnetic objects against the conveyor belt 30 weakens, and the magnetic objects are allowed to fall from the conveyor belt 30. In the illustrated embodiment, a magnetic waste chute 32 is disposed below the conveyor belt 30 at a location slightly inward from the conveyor upper end 29, such that magnetic objects falling from below the conveyor belt 30 are received into the magnetic waste chute 32 and allowed to exit the magnetic waste chute 32 at a discharge opening 34 defined therein.

As shown in FIG. 3, an intake chute 36 is disposed with an open upper end 38 thereof positioned in relation to the conveyor upper end 29 such that non-magnetic aggregate discharged from the conveyor upper end 29 is received in the upper end 38 of the intake chute 36. In the illustrated embodiment, the intake chute 36 comprises a substantially vertically-extending duct positioned substantially beneath the conveyor upper end 29, such that non-magnetic aggregate reaching the conveyor upper end 29 may fall substantially vertically from the conveyor upper end 29 directly into the intake chute 36. However, those of skill in the art will recognize other suitable configurations for the intake chute 36 which may be used without departing from the spirit and scope of the present invention. For example, depending upon the speed at which the conveyor 12 operates, non-magnetic aggregate may be discharged from the conveyor upper end 29 along a trajectory, in which case the intake chute 36 may be positioned relative to the conveyor upper end 29 in order to receive the discharged non-magnetic aggregate at a point along the discharge trajectory of the aggregate. Furthermore, the intake chute 36 may, in certain embodiments, be inclined or otherwise oriented in a non-vertical configuration without departing from the spirit and scope of the present general inventive concept.

In the illustrated embodiment, the intake chute 36 includes a plurality of generally upwardly-extending and outwardly-flared walls 40 positioned about an upper perimeter of the intake chute 36. The walls 40 cooperate to assist in directing non-magnetic aggregate into the upper end 38 of the intake chute 36, thereby limiting spillage of non-magnetic aggregate from the intake chute 36 and the conveyor upper end 26. Furthermore, in the illustrated embodiment, additional walls 41 are provided extending generally upwardly along either side of the conveyor 12 in order to further limit spillage of aggregate from the conveyor 12. However, it will be understood that inclusion of the various walls 40, 41 is not necessary to accomplish the present general inventive concept.

Figure 4:
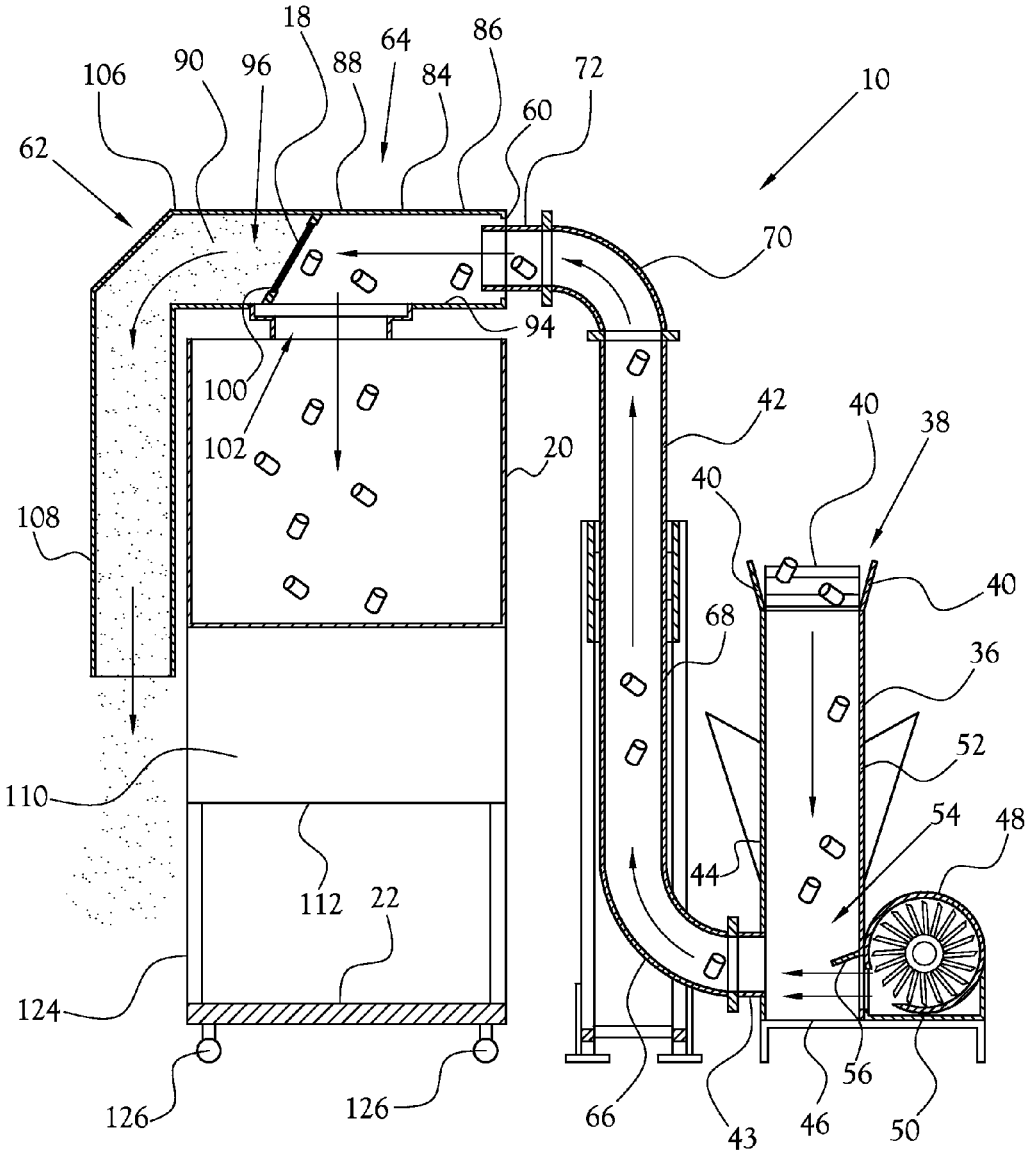
FIG. 4 is a cross-sectional view of the aluminum can cleaning system of FIG. 1 taken along line 4-4.

FIG. 4 illustrates a cross-sectional view of the cleaner 10 showing a bisection of the intake chute 36 along line 4-4. As shown in FIG. 4, upon entry of aggregate into the intake chute 36, the aggregate is allowed to fall to a lower interior 54 of the intake chute 36. In the illustrated embodiment, an air duct 42 is provided having an input end 43 in fluid communication with the lower interior 54 of the intake chute 36 through a first side wall 44 of the intake chute 36 along a lower end 46 thereof. A blower 48 is provided having an output 50 which enters an opposite second side wall 52 of the intake chute 36 at the intake chute lower end 46, such that the blower 48 is able to generate and direct a current of air along the lower interior 54 of the intake chute 36 and into the input end 43 of the air duct 42. The magnitude of the air flow generated by the blower 48 is preferably sufficient to cause the aggregate received within the intake chute 36 to be blown into the air duct 42 and along the length of the air duct 42 as will be discussed further hereinbelow. In the illustrated embodiment, a baffle 56 is provided extending from the second side wall 52 at an angle generally downwardly and toward the first side wall 44 and terminating at a region between the first and second side walls 44, 52. The baffle 56 serves to limit air flow generated by the blower from blowing upwards along the length of the intake chute 36, while allowing aggregate to fall past the baffle 56 and into the intake chute lower interior 54. In this way, the baffle 56 discourages the blower 48 from blowing aggregate outward from the intake chute 36 through the intake chute upper end 38, while allowing aggregate to enter the intake chute lower interior 54 and be blown along the intake chute lower end 48 and into the air duct 42. In the illustrated embodiment, an access door 58 is provided along the intake chute 38 to allow access to the interior of the intake chute 38 near the baffle 56, thereby allowing cleaning and/or maintenance of the baffle and associated components interior of the intake chute 38. However, it will be recognized that provision of the access door 58, while convenient, is not necessary to accomplish the present general inventive concept.

As shown in FIG. 4, the air duct 42 extends from the lower end 46 of the intake chute 38 to an intake opening 60 defined at an upper end 62 of a screening station 64, which will be discussed in greater detail below. In the illustrated embodiment, the air duct 42 includes a lower portion 66 defining an approximately 90-degree upward bend, a middle portion 68 extending substantially vertically, and an upward portion 70 defining another approximately 90-degree bend. Thus, in the illustrated embodiment, the air duct 42 defines an output end 72 which extends generally horizontally to be received within the intake opening 60 of the screening station 64.

Figure 5:
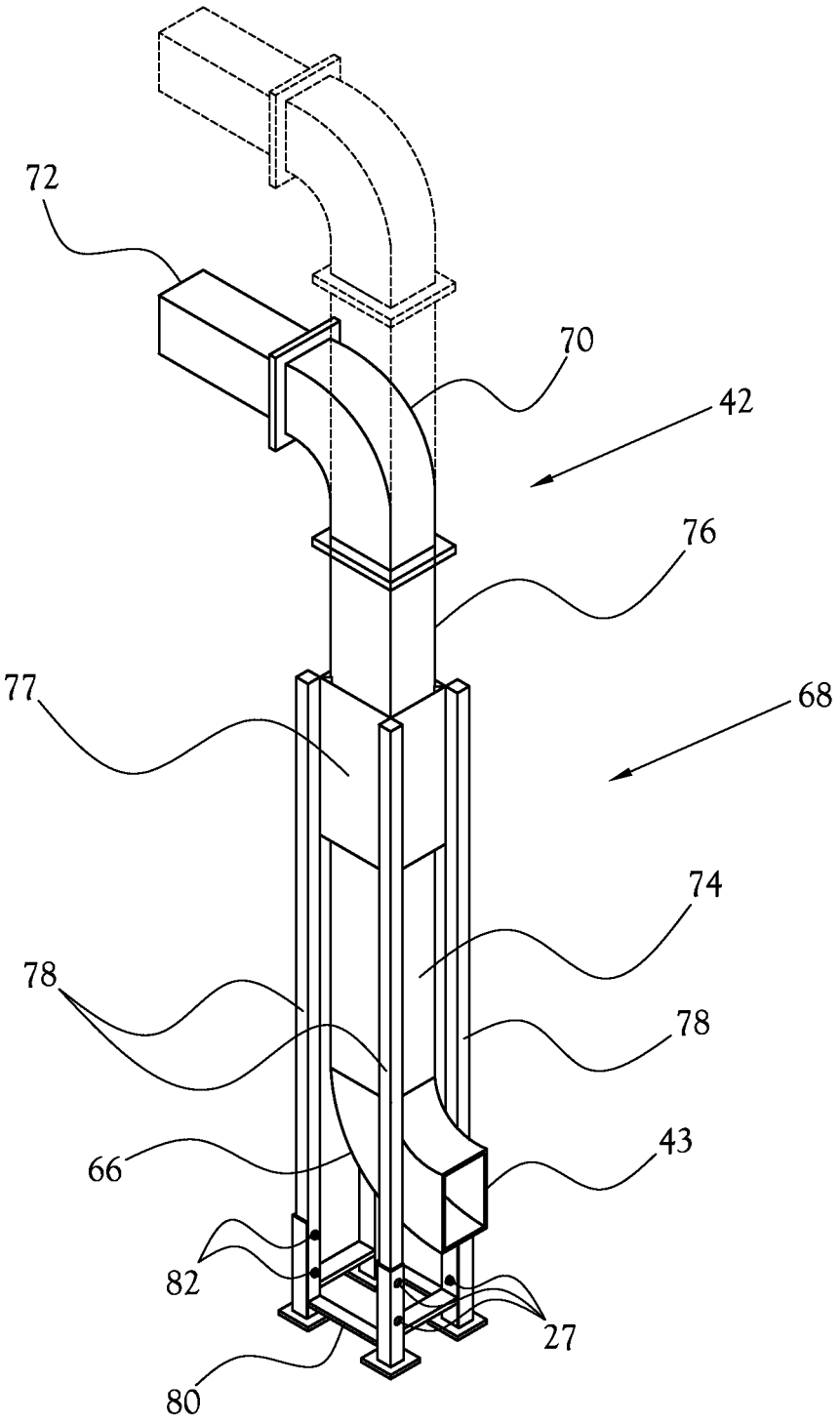
FIG. 5 is a perspective view of the air duct portion of the aluminum can cleaning system of FIG. 1.

In several embodiments, the overall length of the middle portion 68 of the air duct 42 is selectively adjustable, such that the height of the air duct output end 72 can be adjusted. For example, as illustrated in FIG. 5, in one embodiment, the middle portion 68 of the air duct 42 is telescopically adjustable and includes a lower first segment 74 and an upper second segment 76. The second segment 76 is sized slightly smaller in girth than the first segment 74 and is slidably received therein. In the illustrated embodiment, a plurality of legs 78 are fastened to a collar 77 which surrounds an interface between a lower end of the second segment 76 and an upper end of the first segment 74. Suitable clamps (not shown) are provided along the collar 77 to secure the first segment 74 in relation to the second segment 76 to prevent slidable telescopic movement between the first and second segments 74, 76. Thus, the collar 77 serves to serve as a releasable fastener to allow selective adjustable telescopic extension of the second segment 76 from the first segment 74, and thus to allow adjustability of the height of the air duct output end 72. The legs 78 extend generally downwardly along an exterior of the first segment 74 toward a support surface, such as the floor. Each of the legs 78 is adjustably fastened to a support frame 80 via a plurality of fasteners 82, such that the height of the legs 78 in relation to the support frame 80, and hence the height of the input end 43 of the air duct 42, is also adjustable. Those skilled in the art will recognize other devices and configurations which may be suitable to provide adjustability of the height of the air duct input and output ends 43, 72, and such other devices and configurations may be used without departing from the spirit and scope of the present general inventive concept.

Referring again to FIG. 4, the screening station 64 defines a substantially elongated channel 84 extending generally horizontally along an upper portion of the screening station 64, with the intake opening 60 defined at a first end 86 thereof. The channel 84 includes generally an elongated solid top wall 88, elongated opposite side walls 90, 92, and an elongated bottom wall 94, with each of the walls 88, 90, 92, 94 joined along respective elongated edges thereof to form a substantially enclosed corridor 96 therebetween. Thus, with the output end 72 of the air duct 42 received within the intake opening 60, air flow and accompanying aggregate travelling through the air duct 42 is directed generally along the length of the corridor 96 within the channel 84.

As shown in FIG. 4, a screen 18 is positioned along the length of the channel 84, extending between each of the walls 88, 90, 92, 94. The screen 18 defines a plurality of openings of suitable size to allow at least a portion of the debris in the aggregate, and preferably a majority of the debris in the aggregate, to pass through the screen 18, yet to prevent the aluminum cans in the aggregate from passing therethrough. In several preferred embodiments, the screen 18 extends across the corridor 96 at an angled configuration, such that the aluminum cans contacting the screen 18 are urged, either by way of the continued air flow through the corridor 96, the effects of gravity on the aluminum cans, or both, toward a downstream end 100 of the screen 18. For example, in the illustrated embodiment, the screen 18 extends from a section of the top wall 88 relatively nearer the channel first end 86 diagonally downward to a section of the bottom wall 94 relatively further from the channel first end 86. Thus, upon contact with the screen 18 by aggregate including debris and aluminum cans, at least a portion of the debris in the aggregate, and preferably a majority of the debris in the aggregate, passes through the screen 18, while the aluminum cans are urged via the air flow and gravity toward the intersection of the screen 18 with the bottom wall 94.

In the illustrated embodiment, the channel 84 defines an opening 102 at an intersection of the bottom wall 94 and the downstream end 100 of the screen 18. The opening 102 allows the aluminum cans retained by the screen 18 to exit the channel 84 and fall into a bin 20 positioned beneath the channel 84. A second end 106 of the channel 84 is in fluid communication with a discharge chute 108. The discharge chute is configured to direct the air flow and debris passing through the screen 18 generally away from the bin 20 to a point where it may optionally be collected and/or allowed to fall safely. For example, in the illustrated embodiment, the discharge chute 108 extends downwardly alongside the bin 20 and terminates a sufficient distance from the floor or other such supporting surface to allow a container (not shown) to be placed beneath the discharge chute 108 for collection of debris therein. However, those skilled in the art will recognize other suitable configurations for the discharge chute 108 which may be used without departing from the spirit and scope of the present invention.

Referring now to FIGS. 1-4, the bin 20 is configured to serve generally as a storage vessel to store the aluminum cans passing through the channel 84 until such a time as the aluminum cans can be emptied and transported for later processing. In the illustrated embodiment, the bin 20 includes an inclined bottom surface 110 having a lower end 112 intersecting a front wall 114 of the bin 20. A door 116 is provided on the front wall 114 along the intersection of the front wall 114 and the bottom surface 110, such that when the door 116 is opened, aluminum cans within the bin 20 are allowed to fall from within the bin 20. Thus, in certain applications of the present general inventive concept, a suitable container (not shown) may be placed beneath the door 116, whereupon opening the door 116 allows the container to be filled with cleaned aluminum cans from the bin 20. In the illustrated embodiment, the door 116 is hinged along an upper edge 118 thereof to the bin front wall 114, and a handle 120 and latch 122 are provided to allow selective opening and secure closing of the door 116. However, those of skill in the art will recognize other devices and configurations suitable for allowing selective opening and secure closing of the door 116.

In several embodiments, the bin 20 is in operative engagement with a scale 22 which is configured to allow monitoring of the weight of cleaned aluminum cans received in the bin 20. For example, in the illustrated embodiment, the screening station 64, which comprises the channel 84, the bin 20 and the discharge chute 108, is supported by a frame 124, which in turn rests on a scale 22. The scale 22 is configured to allow a user to monitor the overall weight of the screening station 64, thereby monitoring the approximate amount of aluminum cans in the bin 20 and allowing the user to determine when the bin 20 should be emptied. In one embodiment, the scale 22 is initially set to a tare weight such that the scale registers a "zero" weight measurement when the bin 20 is empty. In this embodiment, the scale 22 is configured to provide an accurate weight measurement of the aluminum cans received within the bin 20. In another embodiment, the scale 22 is configured to provide a weight measurement indicative of the combined weight of the screening station 64 and the aluminum cans therein. In yet another embodiment, the scale 22 is provided along the bottom surface 110 of the bin 20, such that the scale 22 is configured to weigh the aluminum cans within the bin 20 only. Those of skill in the art will recognize other configurations for the scale 22 which may be used without departing from the spirit and scope of the present general inventive concept.

In order to allow the scale 22 to weigh the contents of the bin 20 with minimal interference from the air duct 42, in the illustrated embodiment, the screening station 64 is unattached to, and is capable of being slightly separated from, the air duct 42 during use of the cleaner 10. More specifically, with reference to FIGS. 2 and 4, the output end 72 of the air duct 42 is sized slightly smaller than the intake opening 60 of the channel 84. Furthermore, the screening station 64 and associated scale 22 are supported from the floor by a plurality of casters 126 which allow the screening station 64 and associated scale 22 to be repositionable along the floor. As discussed above, the overall height of the output end 72 of the air duct 42 is selectively adjustable. Thus, in operation, the output end 72 of the air duct 42 may be positioned within, or adjacent to, the intake opening 60 of the channel 84 with slight spacing between the respective perimeters of the output end 72 of the air duct 42 and the intake opening 60 of the channel 84. In this configuration, the air duct 42 neither rests upon nor supports the channel 84, thus allowing the scale 22 to more accurately weigh the screening station 64.

From the foregoing description, it will be understood by one of skill in the art that an aluminum can cleaning system 10 for separating magnetic metals from aggregate cleaning debris from aluminum cans and for monitoring the amount of cleaned cans has been provided. While the present invention has been illustrated by description of several embodiments and while the illustrative embodiments have been described in detail, it is not the intention of the applicant to restrict or in any way limit the scope of the appended claims to such detail. Additional modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

Having thus described the aforementioned invention, what is claimed is:

1. An aluminum can cleaning system for separating magnetic materials and other debris from aggregate comprising aluminum cans, said aluminum can cleaning system comprising:

a conveyor for conveying an aggregate from a conveyor receiving end and discharging the aggregate at a conveyor discharge end, said conveyor including a magnet configured to cause said conveyor to retain a magnetic portion of the aggregate along a portion of said conveyor to separate the magnetic portion from a non-magnetic portion of the aggregate;

an intake chute positioned proximate said conveyor discharge end to receive the non-magnetic portion of the aggregate discharged from said conveyor;

an air duct having a first end in fluid communication with a lower end of said intake chute;

a blower configured to provide an air flow from said lower end of said intake chute into said air duct, said air flow being of sufficient magnitude to carry the non-magnetic portion of the aggregate along said air duct;

a channel in fluid communication with a second end of said air duct, said channel having a screen positioned therein, said screen defining openings sized to allow a debris portion of the non-magnetic portion of the aggregate to pass through said screen and to disallow aluminum cans from passing through said screen, said channel defining an opening proximate said screen to allow aluminum cans to exit said channel; and a bin disposed proximate said opening to receive the aluminum cans exiting said channel.

2. The apparatus of claim 1, further including a scale configured to monitor a weight of aluminum cans received in said bin.

3. The apparatus of claim 1, said channel defining a top wall and a bottom wall, said screen extending between said channel top and bottom walls at an angle such that aluminum cans impacting said screen are directed toward said channel bottom wall, said channel opening being defined adjacent said screen on said channel bottom wall.

4. The apparatus of claim 1 further comprising a discharge chute in fluid communication with said channel, said discharge chute being configured to receive debris passing through said screen and to direct the debris to an exterior of said bin.

5. The apparatus of claim 1, said intake chute having an upper end defining a plurality of outwardly flared walls, said intake chute walls cooperating to limit spillage of non-magnetic aggregate from said intake chute.

6. The apparatus of claim 1, said magnet being defined by a magnetic roller positioned at said conveyor discharge end, whereby said magnetic portion of the aggregate is held to said conveyor by said magnetic roller and directed along an underside of said conveyor.

7. The apparatus of claim 6 further including a magnetic waste chute positioned beneath said magnetic roller, whereby as said magnetic portion of the aggregate is directed along an underside of said conveyor and away from said magnetic roller, said magnetic portion of the aggregate is allowed to fall from said conveyor into said magnetic waste chute.

8. The apparatus of claim 1 further including a hopper positioned at said conveyor receiving end, said hopper being configured to receive aggregate therein and direct received aggregate onto said conveyor.

9. The apparatus of claim 8, said hopper defining a generally outwardly-flared upwardly-facing open first end and tapering downwardly and inwardly to an open second end.

10. The apparatus of claim 9, said conveyor including a first side wall disposed along a first side of said conveyor and a second side wall disposed along a second side of said conveyor, said conveyor first and second side walls being configured to limit spillage of aggregate from said conveyor.

11. The apparatus of claim 1, said bin defining a inclined bottom surface having a lower end intersecting a front wall of said bin and a door disposed on said front wall along an intersection of said front wall and said bottom surface, whereby when said door is opened, aluminum cans within said bin are allowed to fall from within said bin.

12. An aluminum can cleaning system for separating magnetic materials and other debris from aggregate comprising aluminum cans, said aluminum can cleaning system comprising:

a conveyor for conveying an aggregate from a conveyor receiving end and discharging the aggregate at a conveyor discharge end, said conveyor including a magnet configured to cause said conveyor to retain a magnetic portion of the aggregate along a portion of said conveyor to separate the magnetic portion from a non-magnetic portion of the aggregate;

an intake chute positioned proximate said conveyor discharge end to receive the non-magnetic portion of the aggregate discharged from said conveyor;

an air duct having a first end in fluid communication with a lower end of said intake chute;

a blower configured to provide an air flow from said lower end of said intake chute into said air duct, said air flow being of sufficient magnitude to carry the non-magnetic portion of the aggregate along said air duct;

a channel in fluid communication with a second end of said air duct, said channel having a screen positioned therein, said screen defining openings sized to allow a debris portion of the non-magnetic portion of the aggregate to pass through said screen and to disallow aluminum cans from passing through said screen, said channel defining an opening proximate said screen to allow aluminum cans to exit said channel;

a bin disposed proximate said opening to receive the aluminum cans exiting said channel; and a scale configured to monitor a weight of aluminum cans received in said bin, wherein said channel, said screen, and said bin are carried by said scale.

13. The apparatus of claim 12, said air duct being of a cross-sectional dimension smaller than said channel, such that a space is defined along an interface of said channel and said air duct.

14. The apparatus of claim 13, said channel being selectively repositionable proximate said air duct.

15. The apparatus of claim 13, said air duct second end being selectively repositionable proximate said channel.

16. The apparatus of claim 14, said air duct being telescopically extendable.

17. The apparatus of claim 15, said air duct including a first segment and a second segment, said second segment slidably received within said first segment, said air duct further including a clamp to selectively limit sliding of said first segment proximate said second segment.

18. The apparatus of claim 16, said air duct first end being selectively repositionable proximate said lower end of said intake chute.

19. The apparatus of claim 17, said air duct being supported by a frame, said frame being selectively adjustable to raise and lower said air duct in relation to said intake chute.

20. The apparatus of claim 18, said frame including a collar joined to said first segment and substantially surrounding an interface of said first segment with said second segment, said clamp being carried by said collar.

* * * * *